United States Patent [19]

Kusui et al.

[11] Patent Number: 4,508,414

[45] Date of Patent: Apr. 2, 1985

[54] SHIELDED CABLE-CONNECTOR ASSEMBLY

[75] Inventors: Akio Kusui; Shuji Morita; Toshio Kudoh, all of Hyogo; Yasuo Tanaka, Saitama; Hirotaka Itoh, Osaka, all of Japan

[73] Assignee: Dainichi-Nippon Cables, Ltd., Amagasaki, Japan

[21] Appl. No.: 434,866

[22] Filed: Oct. 18, 1982

[30] Foreign Application Priority Data

Oct. 30, 1981 [JP] Japan ..... 56-175089
Dec. 29, 1981 [JP] Japan ..... 56-211630

[51] Int. Cl.[3] ..... H01R 13/658

[52] U.S. Cl. ..... 339/143 R; 339/136 M; 339/156 R; 339/177 E

[58] Field of Search ..... 339/143 R, 147 R, 147 P, 339/136 M, 138, 141, 177 E, DIG. 1, 156 R

[56] References Cited

U.S. PATENT DOCUMENTS 1,987,755 1/1935 Skaer et al. ..... 339/143 R X
3,744,128 7/1973 Fisher et al. .
3,775,732 11/1973 Frogner ..... 339/143 R
3,990,765 11/1976 Hill ..... 339/143 R X
4,236,779 12/1980 Tang ..... 339/143 R

FOREIGN PATENT DOCUMENTS 2441669 4/1976 Fed. Rep. of Germany .

*Primary Examiner*—Z. R. Bilinsky
*Attorney, Agent, or Firm*—W. G. Fasse; D. H. Kane, Jr.

[57] ABSTRACT

A shielded cable-connector assembly for interface use comprises a multicore cable (1), a connector (2) and a shielding member made of a metallic mesh (5). The respective cores (11) of the multicore cable are connected to resepective contact elements (21) of the connector and the metallic mesh is disposed to cover the connecting portion of the cores and the contact elements while the same is electrically connected to a metallic contact cover (22) of the connector and a shielding member (12) of the multicore cable, whereby a shielding effect at the connecting portion of the cores and the contact elements is enhanced. A connector cover (24) is provided to cover the whole metallic mesh.

7 Claims, 12 Drawing Figures

SHIELDED CABLE-CONNECTOR ASSEMBLY

BACKGROUND OF THE INVENTION

1. Field of the Invention

The present invention relates to a shielded cable-connector assembly. More specifically, the present invention relates to an improvement in a shielded cable-connector assembly comprising a connector having a plug or a receptacle connected to the end portion of a multicore cable including a plurality of cores covered with a shielding member, for example, a shielding mesh wire or a shielding tape and adapted for use in connecting an interface of a personal computer, for example.

2. Description of the Prior Art

Generally a computer is connectable to a plurality of terminal units such as a line printer, a floppy disk unit and the like and usually an interface bus cable-connector assembly is used for connection of a computer and terminal units. Recently, such computer has been used in a variety of applications including the field of measuring instruments. In particular, recently a personal computer has been used more often at home for personal use. However, employment of a personal computer at home could cause electromagnetic wave interference to a radio receiver, television receiver and the like. The reason is that harmonic components of a logic signal or a clock signal of the frequency of 1 to 4 MHz used in such computer may leak out and enter into a television receiver and the like. For this purpose of preventing this, a shielding device is provided in such computer or terminal units and a cable used in an interface bus cable-connector assembly is also constructed so that the cores are shielded with a shielding member. However, since the end of such interface bus cable-connector assembly is connected to a connector without employment of any shielding measures to the connecting portion of the connector, a harmonic component of such as a logic signal could leak out from the connecting portion.

FIG. 1A is a front view of a conventional interface bus cable-connector assembly which constitutes the background of the present invention. FIG. 1B is a plan view, partially fragmentary, taken along the line 1B—1B in FIG. 1A. Referring to FIGS. 1A and 1B, a conventional multicore cable 1 comprises a multicore of say twenty four conductor cores 11, a shielding mesh wire 12 covering the same, and a jacketing cover 13 covering the shielding mesh wire 12. A connector 2 comprises a plurality of contact elements 21 mutually insulated from each other, a metallic contact cover 22 enclosing these contact elements 21, a fixing portion 23 formed integrally of the contact cover 22, and a connector cover 24 formed as front and rear half shells of the same configuration which are fixed together with screws. The connector cover 24 is formed with a cable inlet 25 at the end, and an engaging groove 26 is formed adjacent to the cable inlet 25. Two clamp members 19 made of metallic plates of the same configuration bent to have an approximately U-shaped configuration are fixed to the engaging grooves 26 with screws for preventing the multicore cable 1 from being detached from the connector 2. The multicore cable 1 is inserted from the cable inlet 25 and the end of the multicore cable 1 is fixed to the connector cover 24 by means of the clamp members 19. The respective conductor cores 11 of the multicore cable 1 are individually connected to the respective contact elements 21. The shielding mesh wire 12 is connected to one of a plurality of contact elements 21 by means of a drain line 14.

FIG. 2 is a diagrammatic view for explaining how to measure a shielding characteristic of an interface bus cable-connector assembly shown in FIGS. 1A and 1B. FIG. 3 is a graph showing a shielding characteristic of the interface bus cable-connector assembly shown in FIGS. 1A and 1B and of the embodiment of the present invention.

Now referring to FIG. 2, an inductive line L1 including 20 AWG soft copper conductors of 0.813 mmØ, for example, and an interface bus cable-connector assembly 1 shown in FIGS. 1A and 1B are disposed approximately 15 mm from a grounding copper plate, not shown, and in parallel with each other with a spacing of approximately 20 mm between the line L1 and the assembly 1. A signal of 0 to 200 MHz is supplied from a signal generator SG through a resistor R1 to one end of the inductive line L1. The other end of the inductive line L1 is connected through a resistor R2 of say 50 Ω to the ground. On the other hand, a voltmeter LM is connected through a resistor R3 of say 50 Ω to any of the contact elements 21 of the connector 2 coupled to one end of the bus cable assembly 1 and the contact elements 21 of the connector 2 at the other end are connected through a resistor R4 of say 50 Ω to the ground. The contact elements which are electrically connected to the shielding mesh wire 12 are connected at both ends to the ground.

When a signal of 0 to 200 MHz and of the voltage V1 is supplied from the signal generator SG to the inductive line L1 in the thus structured measuring circuit, any signal leaking from the inductive line L1 is prevented from entering into the multicore cable 1 inasmuch as the multicore cable 1 is shielded with the shielding mesh wire 12. However, no shielding countermeasure is provided at the connecting portion of the connector 2 and the multicore cable 1 shown in FIG. 1B and therefore a signal leakage from the inductive line L1 could enter into this portion of the assembly 1, whereby a voltage V2 could be displayed by the voltmeter LM. The shielding effectiveness can be evaluated by the following equation based on the above described voltages V1 and V2.

$$\text{shielding effectiveness} = 20 \log (V2/V1)\ (\text{dB})$$

The shielding effectiveness for each frequency in the signal of 0 to 200 MHz is evaluated based on the above described equation. Then, as shown by the dotted line "a" in FIG. 3, a shielding effectiveness of merely 30 dB can be obtained in the vicinity of 120 MHz, for example. More specifically, when a harmonic component of a clock signal, a logic signal or the like in the vicinity of 120 MHz, for example, flows through the interface bus cable-connector assembly 1 shown in FIG. 1B, then the harmonic component leaks outside, whereby electromagnetic wave interference is caused in an FM radio receiver, a television receiver, or the like. A prior art interface bus cable-connector assembly of interest which solved such problems is disclosed in U.S. Pat. No. 3,744,128, entitled "Process for Making R.F. Shielded Cable Connector Assemblies and the Products Formed Thereby", and issued July 10, 1973 to the United States of America. The above referenced United States patent discloses an R.F. shielded cable connector assembly which comprises a multicore cable shielded by a shielding mesh wire, a connector housing, and a resin coating admixed with metallic flakes filled between the multicore cable shielded by the shielding mesh wire and the connector housing for fixing the respective cores and shielding the same. However, a resin material admixed with metallic flakes employed as a shielding material in the interface bus cable-connector assembly disclosed in the above referenced United States patent has large electrical resistance and hence the shielding effect thereof is 20 dB at the most, which is insufficient and has room for improvement. An attempt to increase the shielding effectiveness by increasing the amount of metallic flakes mixed into the resin in the above referenced United States patent can not improve the shielding effect so much in spite of an increase in cost. Since the interface bus cable-connector assembly of the above referenced United States patent involves contact through metallic flakes contained in the resin between the shielding mesh wire of the multicore cable and the connector housing rather than direct metallic contact between the shielding mesh wire of the multicore cable and the connector housing, stability of contact of the metallic flakes with the shielding mesh wire of the multicore cable and the connector housing is lacking. In particular, since the shielding material of the above referenced United States patent is formed by filling in of a resin material, deterioration of the shielding characteristic may be caused due to temperature changes during manufacture and application of a voltage thereacross during usage. In addition, a shielding material made of a resin material admixed with metallic flakes is inevitably weak in terms of mechanical strength and hence cracks may be caused in the resin material when connecting or installing the connector. Thus, a further disadvantage is seen in that this type of connector is not suited for an environment in which the connector must be often connected and disconnected.

SUMMARY OF THE INVENTION

Accordingly, a principal object of the present invention is to provide a shielded cable-connector assembly which is easy to manufacture and has little deterioration of the shielding effect during its use for a long period of time.

The present invention employs a shielding member made of an elastic thin metallic sheet having fine apertures covering the connecting portion of the contact elements connected to the respective cores of a multicore cable, such that the elastic thin metallic sheet may be in electrical contact with the metallic contact cover of a connector and with a shielding mesh wire of a multicore cable.

Thus, according to the present invention, an elastic thin metallic sheet of an expanded metal is employed as a shielding material whereby the contact resistance between the metallic contact cover and the shielding mesh wire of the multicore cable has been decreased, thereby to attain an ample shielding effect. Such elastic thin metallic sheet having fine perforations employed as a shielding material has some flexibility as compared with a mere metallic sheet and few cracks are caused in the shielding material even in the case of repetitive and frequent connection and disconnection of the connector, with the result that little or no deterioration of the shielding effectiveness is caused. Furthermore, such elastic thin metallic sheet employed as a shielding material is less fragile as compared to a resin material admixed with metallic flakes and hence can eliminate various restrictions in use time and use manner. Since the shielding member is formed with such elastic thin metallic sheet, a state of the member as formed can be maintained as it is and a time dependent change due to an environmental influence such as external vibration, ambient temperature and the like is eliminated and deterioration of the shielding characteristic have be considerably decreased.

In a preferred embodiment of the present invention, the respective cores of a multicore cable are connected to the contact elements and then a resin material is coated around the connecting portion, whereupon an elastic thin metallic sheet such as a metallic mesh, expanded metal, a metal plated cloth obtained by plating a chemical textile fabric or the like is covered on the above described coated resin portion, whereupon the elastic thin metallic sheet is soldered to the metallic contact cover of the connector and to the shielding mesh wire of the multicore cable.

According to the preferred embodiment of the present invention, a shielding material is provided as a thin flexible expanded metal sheet which is soldered to the metallic contact cover of the connector and to the shielding mesh wire of the multicore cable. Therefore, electrical contact between the shielding mesh wire of the multicore cable, the shielding member of the metallic contact cover can be made complete and as a result a stabilized shielding effectiveness has been attained.

In another preferred embodiment of the present invention, a resin material is further molded on the expanded metal sheet so that the resin material can enter into the fine perforations, thereby to achieve intimate adhesive bonding of the molded resin to the elastic thin metallic sheet. As a result, the structure is mechanically strong and the possibility of damaging the molded portion and the shielding member during use has been decreased.

These objects and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

Figures 1A, 1B:
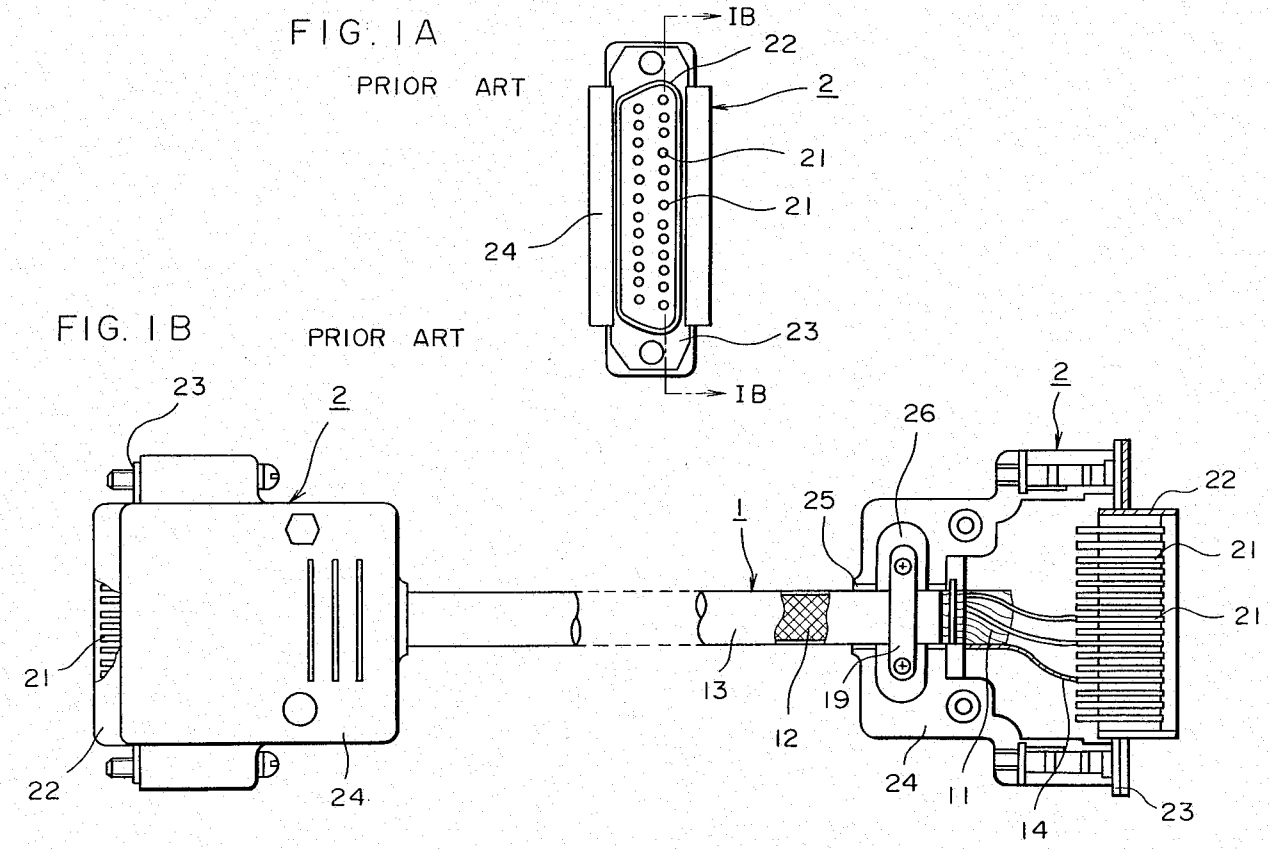
FIG. 1A PRIOR ART
FIG. 1B PRIOR ART
FIG. 1A is a front view of an interface bus cable-connector assembly which constitutes the background of the present invention.
FIG. 1B is a plan view of the FIG. 1A interface bus cable-connector assembly, fragmentary in part, taken along the line 1B—1B in FIG. 1A.
Figures 4A, 4B:
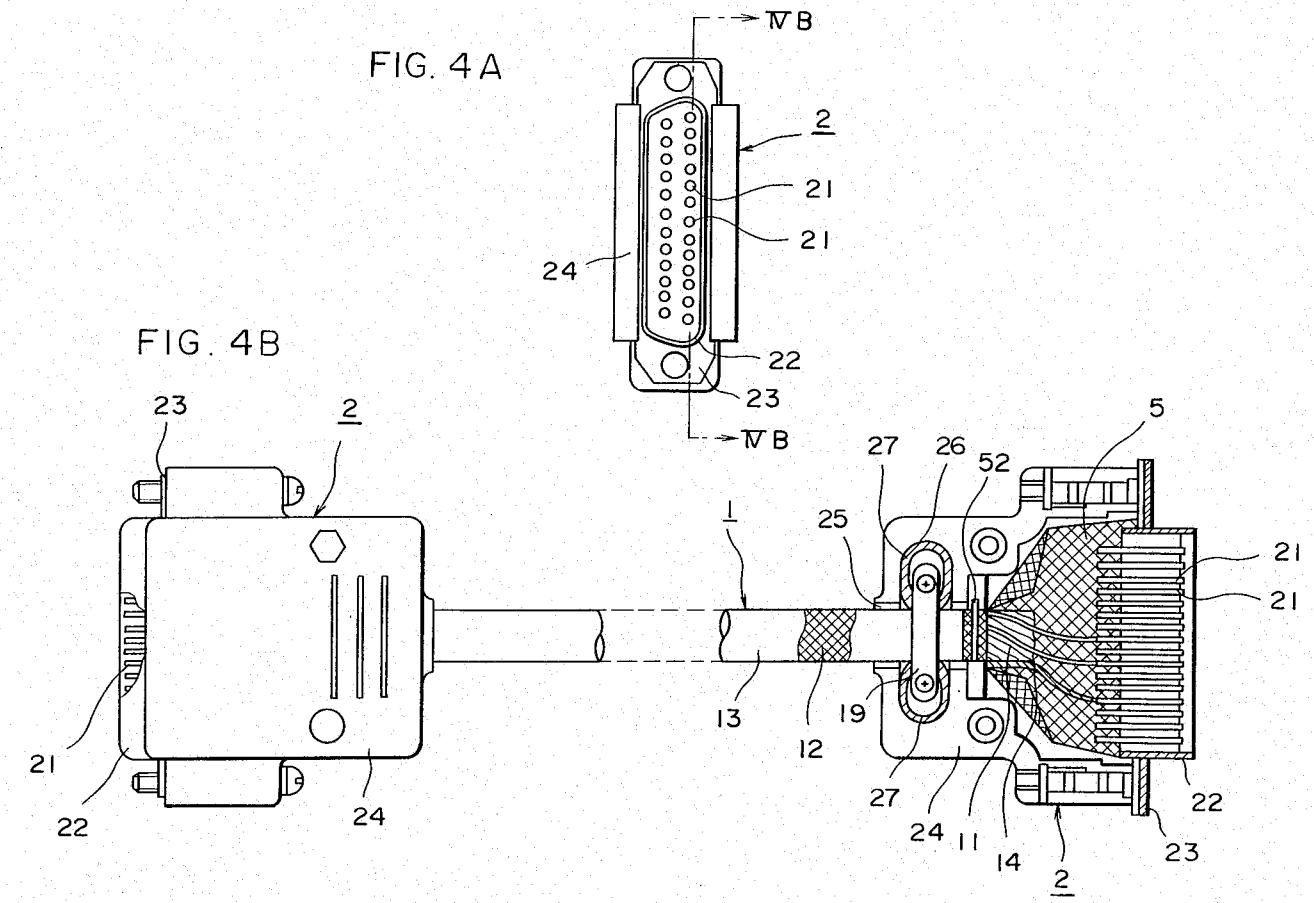
FIG. 4A is a front view of one embodiment of the present invention.
FIG. 4B is a plan view of the FIG. 4A embodiment, fragmentary in part, taken along the line IVB—IVB in FIG. 4A.

Referring to FIGS. 4A and 4B, a shielded cable-connector assembly including a multicore cable 1 and a connector 2 at each end is constructed substantially in the same manner as shown in FIGS. 1A and 1B. An engaging groove 26 formed on the inner surface of the connector cover 24 is provided with a ring shaped elastic member 27 made of synthetic resin serving as a damper for supporting a clamp member 19. The elastic member 27 prevents play of the clamp member 19 from taking place in a spacing formed between a clamp member 19 and the connector cover 24 and also prevents a force from being exerted on the connecting portion of the respective conductor cores 11 and the contact elements 21 even in the case where the multicore cable 1 is twisted, thereby to prevent poor contact, disconnection or the like from occurring at the connecting portion.

A shielding member 5 constituting an essential feature of the present invention is provided for the purpose of enclosing the connecting portion of the respective conductor cores 11 of the multicore cable 1 and a plurality of contact elements 21. The shielding member 5 is formed of an elastic thin expanded metal sheet having fine apertures therein, by forming a number of slits 51 in a metal tape in the longitudinal direction and by expanding the tape in the lateral direction. Alternatively, such elastic thin metallic member may be a metal plated cloth obtained by plating metal such as copper, silver, nickel or the like on a cloth. Such metal plated cloth is obtainable by chemical plating, electric plating, vacuum evaporation, metal spraying, ion plating, sputtering, or the like on a woven or nonwoven fabric made of acrylic resin, polyester, nylon, polypropylene, or the like. The shielding member 5 is formed of such elastic thin expanded metal sheet member and the shielding member 5 is brought in electrical contact with a shielding mesh wire 12 and with a contact cover 22 of the multicore cable 1.

Now a method of fixing the shielding member 5 to the connector 2 will be described. First the respective conductor cores 11 of the multicore cable 1 are electrically connected by soldering to the respective contact elements 21 of a plug of the connector 2 shown in FIG. 4B to form a connecting portion including the contact elements 21 connected to the respective conductor cores 11. The connecting portion is protected or reinforced with an insulating tape such as an adhesive glass tape or it is enclosed by molding a polyethylene resin or epoxy resin housing into intimate bonding contact with the connecting portion. The shielding member 5 with its slits 51 is then shaped around the connector so as to enclose the connecting portion of the conductor cores 11 of the multicore cable 1 and the contact elements 21. Then the shielding member 5 extends to a portion of the contact cover 22 and is soldered to the contact cover 22. A portion of the shielding member 5 on the side of the multicore cable 1 is soldered together, or bound together with the shielding mesh wire 12 of the multicore cable 1 by means of soldering or a binding wire 52, for example, of copper, whereby the shielding member 5 is electrically connected to the shielding mesh wire 12.

Thus the connecting portion of the respective conductor cores 11 of the multicore cable 1 and of the contact elements 21 is covered by the shielding member 5 while the contact cover 22 and the shielding mesh wire 12 of the multicore cable 1 are electrically connected with the shielding member 5 which has assumed and retains the shape of the connecting portion as shown in FIG. 4B. Furthermore, a connector cover 24 made of synthetic resin such as polyvinyl chloride and having substantially the same geometry on both the outer and inner surfaces is integrally fit and fixed with screws so as to wholly cover the shielding member 5. Alternatively, the connector cover 24 may be formed by directly molding synthetic resin onto the shielding member 5 so as to cover the shielding member 5 and the end portion of the multicore cable 1.

Figure 2:
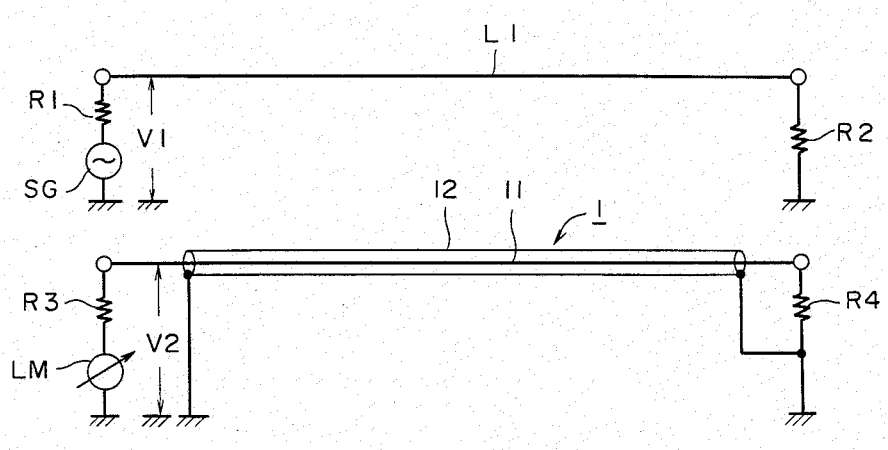
FIG. 2 PRIOR ART
FIG. 2 is a view of a testing arrangement for measuring a shielding characteristic of an interface bus cable-connector assembly, for example, as shown in FIGS. 1A and 1B.
Figure 5:
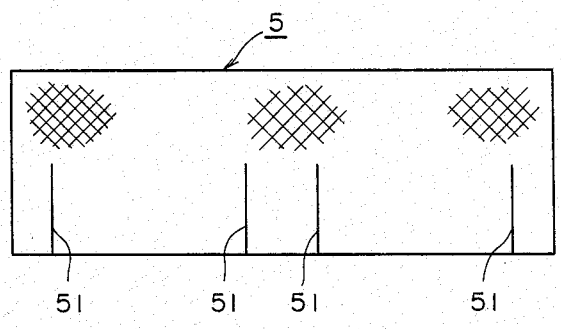
FIG. 5 is a view showing an expanded metal shielding member employed in one embodiment of the present invention.
Figure 3:
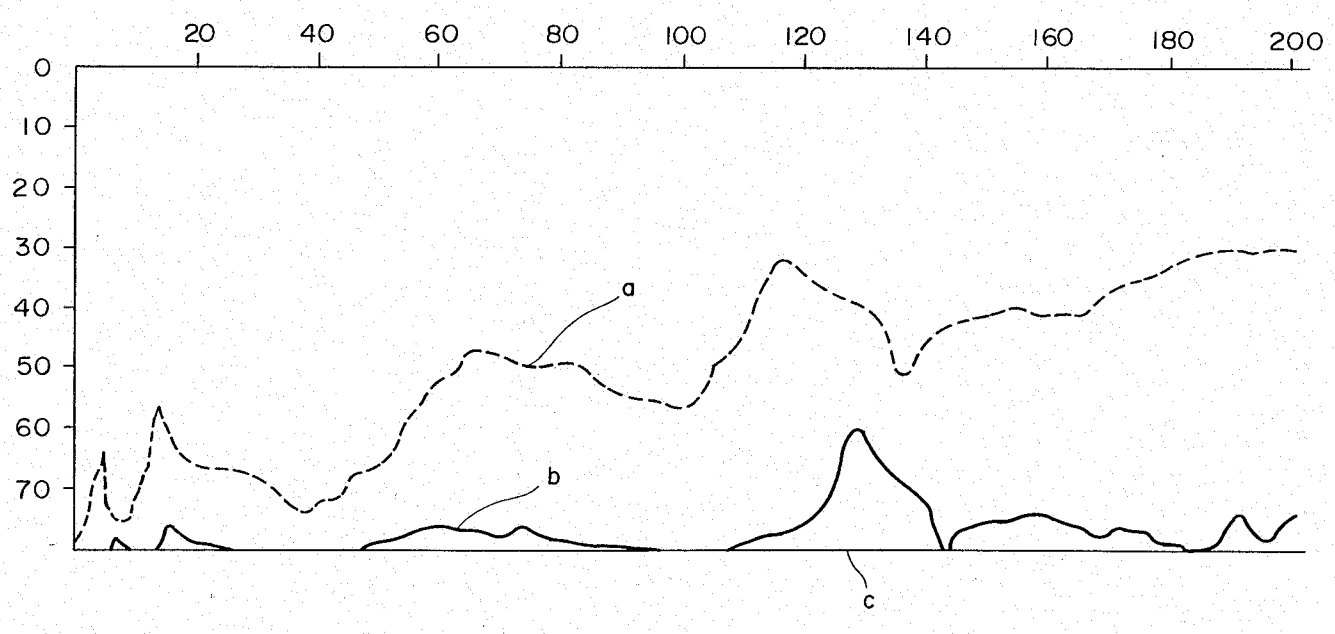
FIG. 3 PRIOR ART
FIG. 3 is a graph showing the shielding characteristic a of the conventional bus cable-connector assembly shown in FIGS. 1A and 1B and the shielding characteristic "b" of one embodiment of the present invention.

The shielding characteristic of the shielded cable-connector assembly thus structured was measured using a measuring circuit arrangement shown in FIG. 2 and the characteristic curve as shown by the solid line curve "b" in FIG. 3 was obtained for the embodiment of FIGS. 4A, 4B. More specifically, it is clear from FIG. 3 that there is little signal leakage in the frequency range below the frequency of 120 MHz and the signal leakage was as small as below a measurable limit as shown by the solid line curve "c" in FIG. 3. Signal leakage in the vicinity of the frequency of 130 MHz was controlled to be as small as 60 dB. Since the shielding member 5 was formed of an elastic thin metallic sheet such as a metallic mesh and the shielding member 5 was electrically connected by soldering to the contact cover 22 and the shielding mesh wire 12 of the multicore cable 1, electrical resistance between the contact cover 22, the shielding member 5, and the shielding mesh wire 12 of the multicore cable 1 can be decreased and the shielding characteristic can be improved. Furthermore, since the shielding member 5 was formed of an elastic thin metallic sheet, there is no danger that cracks are caused due to mechanical shock applied to the connector 2 from the outside. Accordingly, a time dependent change of the characteristic during a long period of use has been eliminated.

Figure 6:
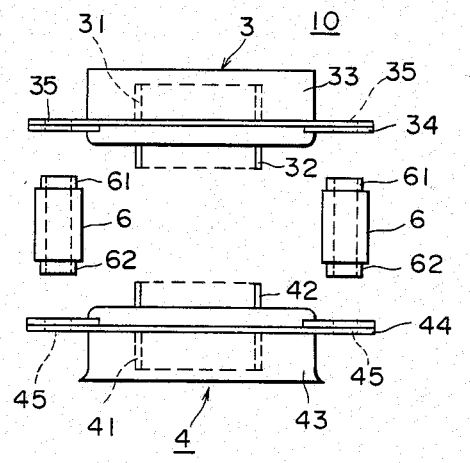
FIG. 6 is a side view of a connector, in a disassembled state, employed in another embodiment of the present invention.
Figure 7:
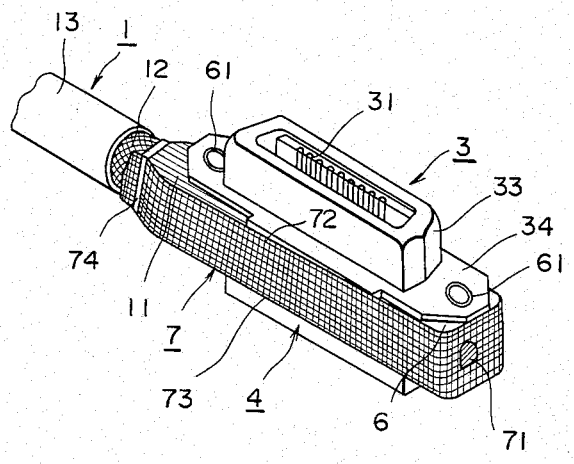
FIG. 7 is a perspective view of a major connector portion of the other embodiment of the present invention.

Now referring to FIGS. 6 to 9 a further embodiment of the present invention will be described. The multicore cable 1 employs the same structure as shown in FIG. 1B. The connector 10 is constructed so that a female receptacle 3 and a male plug 4 may be mated as shown in FIG. 6. The receptacle 3 comprises a plurality of receptacle contact elements 31, a metallic contact cover 33 enclosing the receptacle contact elements 31, and a metallic fixing portion 34. Similarly, the plug 4 comprises a plurality of plug contact elements 41, a contact cover 43 and a fixing portion 44. The fixing portion 34 of the receptacle 3 is formed with two apertures 35 and similarly the fixing portion 44 of the plug 4 is also formed with two apertures 45. The receptacle 3 and the plug 4 are disposed to be mated with each other and cylindrical spacers 6 are provided for the purpose of uniting the receptacle 3 and the plug 4. Projections 61 and 62 are formed at both ends of each of the spacers 6. The projection 61 at one end of each of the spacers 6 is inserted into each of the apertures 35 of the receptacle 3 and the upper end thereof is calked. Similarly, the protrusion 62 at the other end of each spacer 6 is inserted into the aperture 45 of the plug 4 and the lower end thereof is calked. A lock screw 55 (see FIG. 8B) is inserted into the spacer 6 through the aperture 45 of the fixing portion 44. The fixing portion 32 of the contact elements 31 of the receptacle 3 and the fixing portion 42 of the contact elements 41 of the plug 4 are connected to each other to form respective connected portions 8 and the respective conductor cores 11 of the multicore cable 1 are individually connected to the respective connected portion 8. The shielding mesh wire 12 is connected to any one of the connected portions 8 by the drain line 14. The shielding member 7 may be an elastic thin metallic member having fine apertures such as a metallic mesh, expanded metal sheet, metal plated cloth or the like described previously formed in a tape shape, as described with reference to FIGS. 4A and 4B.

Figure 8A:
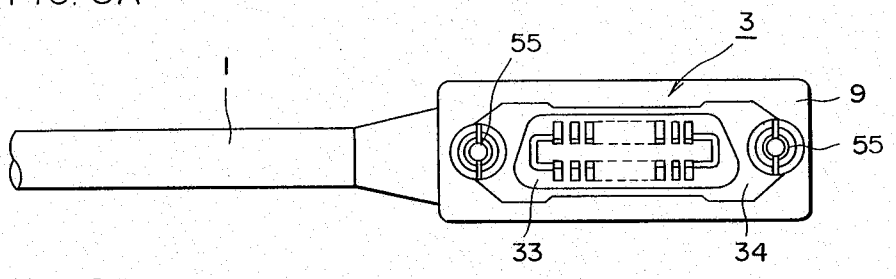
FIG. 8A is a plan view of the other embodiment of the present invention.
Figure 8B:
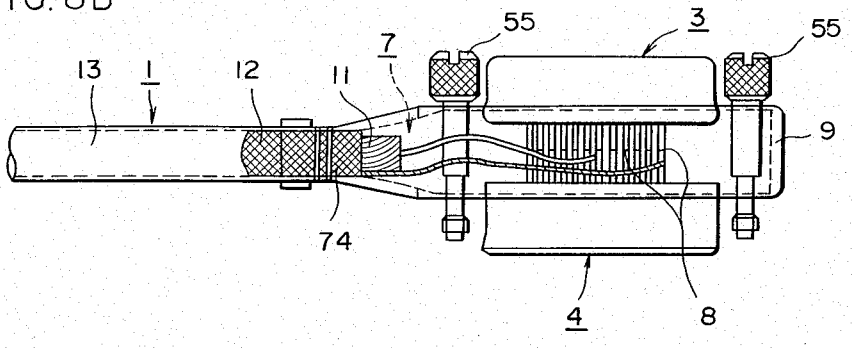
FIG. 8B is a front view, partially in section, of a major connector portion of the other embodiment of the present invention.

Now a method of fixing the shielding member 7 to the connector 10 will be described. First the contact elements 31 of the receptacle 3 and the contact elements 41 of the plug 4 shown in FIG. 6 are brought close to each other for connection whereby a connecting portions 8 are formed, as shown in FIG. 8B, whereupon the respective cores 11 of the multicore cable 1 are connected to the connecting portions 8 by soldering or the like. The connecting portions 8 are then covered by molding a polyethylene resin, epoxy resin or the like cover onto these portions 8. The connecting portions 8 of the receptacle 3 and of the plug 4 with the molded cover fixed thereto are enclosed with the shielding member 7, e.g., a metal tape. At that time, a portion 71 at the tip end of the shielding member 7 is brought in contact with the spacer 6 and is soldered. An edge 72 along the fixing portion 34 of the receptacle 3 and an edge 73 along the fixing portion 44 of the plug 4 of the shielding member 7 are brought in electrical contact with and soldered to the fixing portions 34 and 44 respectively. The shielding member 7 on the side of the multicore cable 1 is bound by a binding wire 74 of, e.g. copper, so that the shielding mesh wire 12 may be covered by the shielding member 7 and then the shielding mesh wire 12 and the shielding member 7 are electrically connected to each other. Thus the connecting portions 8 are covered with the shielding member 7 and the fixing portion 34 of the receptacle 3, the contact cover 33 of the receptacle 3, the fixing portion 44 of the plug 4, and the contact cover 43 of the plug 4 are electrically connected to the shielding member 7. Then, as shown in FIG. 8A, a synthetic resin material 9 such as polyvinyl chloride is molded to cover the shielding member 7 and the end portion of the multicore cable 1 at the connector side.

Figure 9:
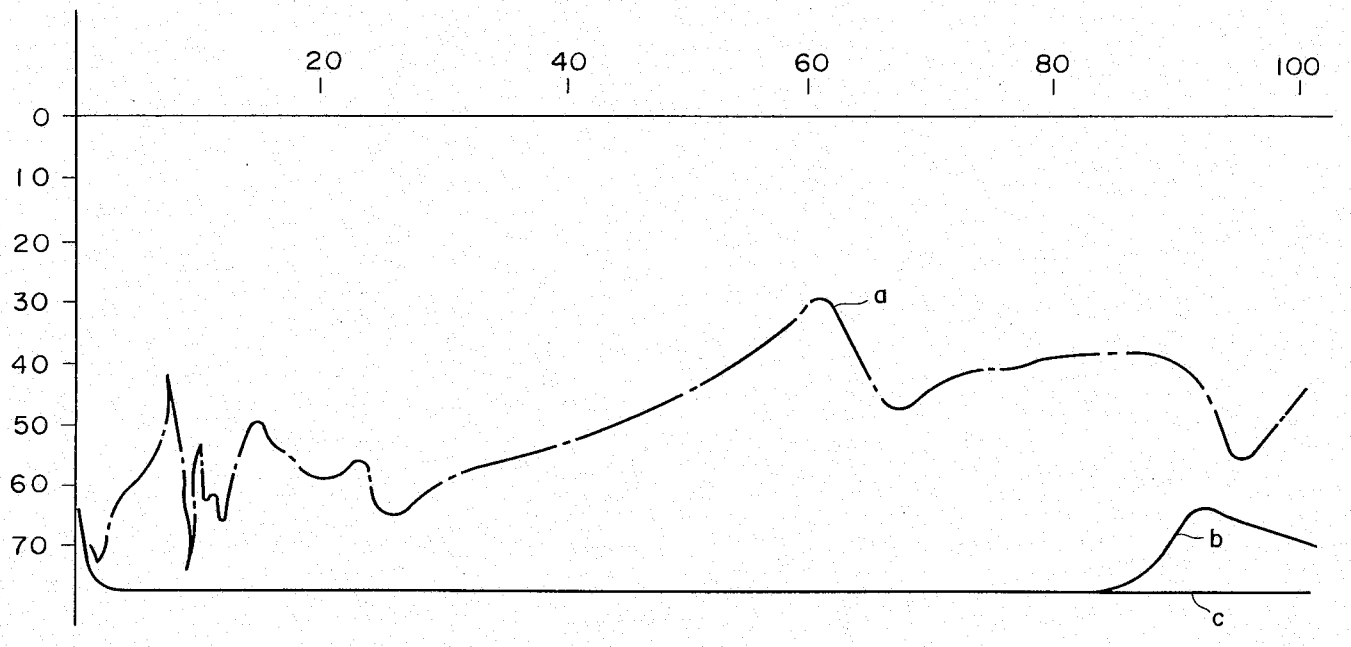
FIG. 9 is a graph showing the shielding characteristic of another embodiment of the present invention.

The shielding characteristic of the shielded cable-connector assembly constructed as described above was then measured using the measuring circuit arrangement shown in FIG. 2 and the characteristic of the solid line curve "b" shown in FIG. 9 was obtained. More specifically, as seen in FIG. 9, there is little signal leakage in the frequency region below 85 Mhz and the signal leakage was as small as below a measurable limit as shown by the solid line curve "c" in FIG. 3. According to the embodiment of FIGS. 6 to 9, the signal leakage has been controlled to be as small as 60 dB in the vicinity of 85 MHz to 100 MHz. Referring to the shielding characteristic shown in FIG. 9, the dotted line curve "a" shows a curve where no shielding measure has been employed while the full line curve "b" shows a measurable limit of the present embodiment. Since the embodiment also employs an elastic thin metallic sheet having fine apertures as the shielding member 7; and the shielding member 7 is directly connected to the fixing portion 34 of the receptacle 3, the fixing portion 44 of the plug 4 and the shielding mesh wire 12 of the multicore cable 1, the electrical resistance between these can be made extremely small. Furthermore, since a synthetic resin material 9 is molded onto the surface of the shielding member 7, the synthetic resin material 9 enters through the fine apertures of the shielding member 7 whereby the molded portion and the shielding member 7 enter into a strong intimate adhesive bond which reinforces the shielding member 7.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A shielded cable-connector assembly, comprising: a multicore cable (1) including a plurality of conductor cores (11) and a shielding member (12) enclosing said cable conductor cores in a shielding manner, a connector (2) including a plurality of mutually insulated contact elements (21) and a metallic contact cover (22) enclosing said plurality of contact elements in an electrically insulating manner, each of said cable conductor cores of said multicore cable being electrically connected to its respective contact element of said plurality of contact elements in a connecting portion, shielding means comprising an initially flexible thin sheet of expanded metal having fine apertures and surrounding said connecting zone in an insulating manner, means electrically connecting said thin sheet of expanded metal to said metallic contact cover (22) and to said shielding member (12) of said multicore cable, and molded protective outer cover means (9, 24) made of a moldable material integrally molded onto said initially flexible thin sheet of expanded metal in a molding operation causing said moldable material to enter into said fine apertures of said initially flexible thin sheet of expanded metal, whereby said initially flexible thin sheet of expanded metal is reinforced by said moldable material when the moldable material has hardened and filled said fine apertures, said protective outer cover means covering an end portion of said multicore cable at its connector side.

2. The shielded cable-connector assembly in accordance with claim 1, wherein said connector assembly comprises a male plug.

3. The shielded cable-connector assembly in accordance with claim 1, wherein said connector assembly comprises a female receptacle.

4. The shielded cable-connector assembly in accordance with claim 1, wherein said connector comprises a plug (4) including a fixing portion (44) and a receptacle (3) including a respective fixing portion (34), said plug and said receptacle being arranged back to back, said plug and said receptacle each having contact elements (31, 41) with connecting portions, whereby a connecting portion of the plug and a connecting portion of the receptacle form a pair of contact connecting portions (8) connected to each other, wherein the conductor cores of said multicore cable are connected to a respective pair of connecting portions of said contact elements (31) of said plug and of said contact elements (41) of said receptacle, and wherein said flexible thin sheet of expanded metal having said fine apertures encloses both of said fixing portions (34, 44) and said connecting portions (8).

5. The shielded cable-connector assembly in accordance with claim 4, wherein said molded protective outer cover means include a molded member enclosing said connecting portions (8) of the respective conductor cores (11) of said multicore cable and said contact elements of said connector assembly.

6. The shielded cable-connector assembly in accordance with claim 1, wherein said flexible thin sheet of expanded metal is electrically connected to said shielding member (12) of said multicore cable and to said metallic contact cover (22) by soldering.

7. The shielded cable-connector assembly of claim 1, wherein said thin sheet of expanded metal comprises a thin metal tape having a number of slits (51) extending in a longitudinal direction in the tape, said slits (51) forming said fine apertures when said thin metal tape with the slits (51) therein is expanded in a lateral direction substantially perpendicularly to said longitudinal direction

* * * * *